United States Patent [19]

Fukuma et al.

[11] Patent Number: 4,689,864

[45] Date of Patent: Sep. 1, 1987

[54] METHOD OF MAKING VALVE SLEEVES

[75] Inventors: Nobuo Fukuma, Toyota; Hisayasu Hasegawa, Aichi; Kimimasa Murayama, Toyota; Kunio Hayashi, Nagoya; Yoshihiro Tokudome, Toyota, all of Japan

[73] Assignee: Toyota Jidosha Kabushiki Kaisha, Aichi, Japan

[21] Appl. No.: 843,820

[22] Filed: Mar. 28, 1986

Related U.S. Application Data

[63] Continuation of Ser. No. 661,920, Oct. 17, 1984, abandoned, which is a continuation-in-part of Ser. No. 515,635, Jul. 20, 1983, abandoned.

[30] Foreign Application Priority Data

Jul. 28, 1982 [JP] Japan ..... 57-131738

[51] Int. Cl.[4] ..... B21D 53/00

[52] U.S. Cl. ..... 29/157.1 R; 29/558; 29/DIG. 26; 72/370; 72/412

[58] Field of Search ..... 29/157.1 R, 557, 558, 29/33 D, DIG. 26; 251/366; 308/5 R, 5 V; 72/370, 412; 137/625.24, 625.3; 91/375 R, 375 A; 464/24, 26, 153, 154

[56] References Cited

U.S. PATENT DOCUMENTS

| | | | |
|---|---|---|---|
| 1,870,970 | 8/1932 | Stevenson | 29/157.1 R |
| 3,503,246 | 3/1970 | Shiokawa | 72/370 |
| 3,626,564 | 12/1971 | Daniel | 72/370 |
| 3,740,993 | 6/1973 | Moore, Sr. | 72/375 |
| 3,765,305 | 10/1973 | Bishop | 409/305 |
| 3,921,669 | 11/1975 | Goff | 29/157.1 R |
| 4,237,713 | 12/1980 | Benteler et al. | 72/370 X |
| 4,270,690 | 6/1981 | Mabery et al. | 72/370 X |
| 4,285,366 | 8/1981 | Elser | 137/625.3 |
| 4,425,696 | 1/1984 | Törniainen | 72/370 X |
| 4,428,220 | 1/1984 | Rammesten | 72/370 |
| 4,428,399 | 1/1984 | Masuda et al. | 91/375 R |
| 4,442,579 | 4/1984 | Millard | 29/157.1 R |
| 4,543,813 | 10/1985 | Rogers | 72/370 |
| 4,554,817 | 11/1985 | Dier | 72/370 |

FOREIGN PATENT DOCUMENTS

| | | | |
|---|---|---|---|
| 36416 | 9/1980 | Japan | 72/370 |
| 733829 | 5/1980 | U.S.S.R. | 72/377 |
| 902975 | 2/1982 | U.S.S.R. | 72/370 |

*Primary Examiner*—Howard N. Goldberg
*Assistant Examiner*—Ronald S. Wallace
*Attorney, Agent, or Firm*—Parkhurst & Oliff

[57] ABSTRACT

A method of making valve sleeves used for controlling the flow of hydraulic fluid in devices, such as power steering units in motorized vehicle, and the product of the utilized method. The method utilizes a grooving male die which forms a groove on an interior surface of a valve sleeve.

3 Claims, 22 Drawing Figures

METHOD OF MAKING VALVE SLEEVES

This a continuation of application Ser. No. 661,920, filed Oct. 17, 1984, now abandoned, which in turn is a continuation in part of Ser. No. 515,635, filed July 20, 1983, now abandoned.

BACKGROUND OF THE INVENTION

The present invention relates to a method of making valve sleeves and the actual valve sleeves produced by utilizing this method, particularly reference is made to the construction of valves utilized in two directional hydraulic control systems such as power steering in motorized vehicles.

In recent years, four way valves for two directional control system installations have been of the rotary type. In such rotary type valves, a valve core of a generally cylindrical configuration is rotatably mounted within a valve sleeve. The valve and sleeve each contain a plurality of axially extending mated grooves and contain ports for the controlled flow of hydraulic fluid within the grooves. The actual flow is dependent upon the degree of relative rotation between the valve core and the valve sleeve. Heretofore, the valve sleeves for the rotary valves have had annular grooves on the outer peripheral surface providing for porting of the hydraulic fluid and axial grooves on the interior surface which also provided for the flow of hydraulic fluid. In order to eliminate the defects of a three-piece valve which comprises three pieces of valve sleeve and two rings secured to the ends of the sleeve, and to substantially reduce the cost to manufacture the same, a one-piece valve sleeve has been proposed. In a one piece valve sleeve, the internal slots of the sleeve terminate before reaching the ends of the sleeve. A method of making these valve systems has been shown and discussed in prior art references such as U.S. Pat, No. 3,765,305, by Arthur E. Bishop.

FIGS. 1–6 illustrate prior art power steering valve sleeves. In FIGS. 1 and 2, a valve body 1 is manufactured by a grooving machine. The annular valve sleeve 2 has grooves of circular arc, when viewed in longitudinal cross section, (as shown in FIG. 1) and are rectangular in shape when viewed in transverse cross section (as shown in FIG. 2). The valve body 1 in FIGS. 3 and 4, is manufactured by some type of machining, such as ball end milling, and contains spherical slots 3 on the interior surface of the annular valve sleeve 2. FIGS. 3 and 4 show that the groove 3 is machined into the interior of the valve sleeve 2 and do not extend to both ends of the sleeve. Therefore, in accordance with known groove machining techniques, the size of the cutter for making grooves on the valve sleeve 2 is limited by the size of the interior portion of the valve sleeve 2. Because the cutter must be inserted into the inner portion of the valve sleeve 2, the result is long machining time and nonprecise machined grooves.

In order to overcome the aforementioned disadvantages, a multi-piece valve body 1, such as the one disclosed in FIGS. 5 and 6, has been employed. In FIGS. 5 and 6, the valve body 1 comprises an annular valve sleeve 2 and rings 4. The grooves 3, which allow for flow of hydraulic fluid, extend longitudinally along the valve sleeve 2 and are produced by appropriate machining techniques. The rings 4 are press-fitted into both ends of the sleeve 2 for sealing the entire unit. By utilizing the aforementioned manufacturing process, it is relatively easy to form a variety of differently machined grooves. However, it costs more to produce an increased number of parts and also results in an increase in manufacturing time. Further, if the rings 4 are not properly press-fitted into both ends of the valve sleeve 2, the result is oil leakage. In order to avoid this leakage, strict tolerance standards must be adhered to when manufacturing the annular valve sleeve 2 and the rings 4.

SUMMARY OF THE INVENTION

The present invention was made in view of the foregoing background and to overcome the foregoing drawbacks. It is accordingly an object of this invention to provide a method for making valve sleeves and by utilization of this method produce valve sleeves for use in hydraulic control systems such as the ones employed in power steering units in motorized vehicles.

To attain the above objects, a method according to the present invention comprises:

a method of machining a valve sleeve on a device having a base, a support member fixedly secured to the base, a shaft mounted on the support member, and a male die secured to the shaft, comprising:

(a) mounting an annular cylindrical workpiece on the male die;

(b) applying pressure to the workpiece in a direction toward the male die;

(c) forging the workpiece by applying pressure to it toward the male die, thereby forming a first groove on an interior surface of the workpiece;

(d) applying pressure to the workpiece in a direction away from the male die;

(e) rotating the workpiece a predetermined amount;

(f) repeating steps (c) through (e), thereby forming multiple grooves in the workpiece until a predetermined number of grooves have been formed in the workpiece ending with a final groove being formed adjacent to the first groove; and (g) machining at least one of the multiple grooves adjacent to the final groove a second time.

BRIEF DESCRIPTION OF THE DRAWINGS

The above objects, features and advantages of the present invention will become more apparent from reading the following description of the preferred embodiments taken in conjunction with the accompanying drawings, wherein.

DETAILED DESCRIPTION OF THE PREFERRED EMBODIMENTS

The present invention is described in detail with reference to the accompanying drawings which illustrate different embodiments of a method for making valve sleeves and different valve sleeves constructed according to the claimed invention.

Figure 7:
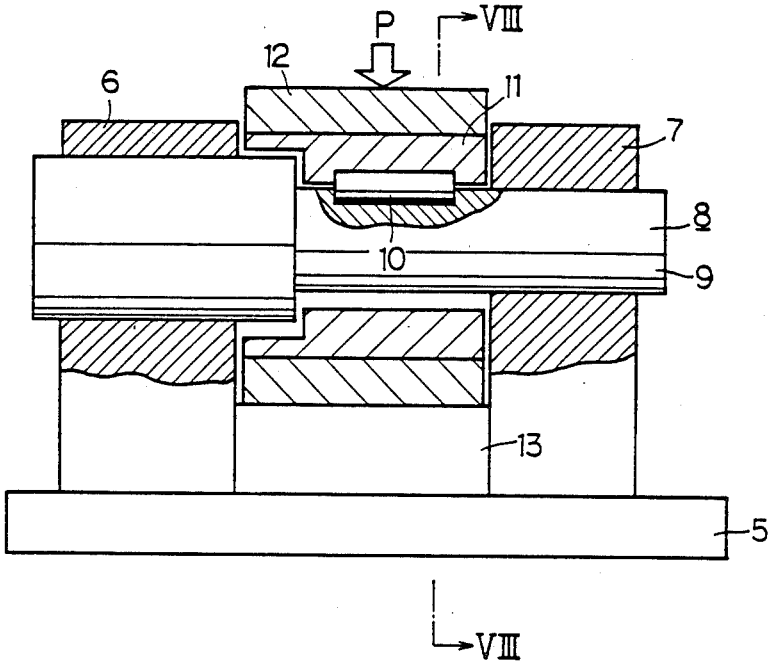
FIG. 7 is a longitudinal cross-sectional view of machining device utilized for manufacturing a valve body according to the first embodiment of the present invention.

In reference to the drawings, like reference characters have been used whenever possible to designate corresponding like parts in each device in each of the several views. FIG. 7 shows a longitudinal cross-sectional view of a machining device utilized for manufacturing a valve body according to the first embodiment of the claimed invention. The support members 6 and 7 are firmly secured onto a base 5. A forging die 8 is horizontally mounted on the support members 6 and 7. The forging die 8 comprises a shaft portion 9 and a projecting male die 10 which is utilized to form a groove on the interior surface of a valve body. The workpiece 11, which is an annular cylinder, is placed upon the male forging die with the interior area of the cylinder resting upon the male die for purposes of creating a groove therein. An annular cover 12 is secured onto the outer periphery of the workpiece 11. A pressure P, indicated by the arrow in FIG. 7, is applied through the annular cover 12 to the workpiece 11 resulting in the workpiece 11 contacting the male die 10 and thus forming a groove on the interior surface of the workpiece 11.

A conventionally known pushing device, having vertical mobility, is located under the forging die 8. After a groove 3 has been formed on the interior surface of workpiece 11, the pushing device 13 contacts the underside of the annular cover 12 and lifts the workpiece 11 off of the male die 10. The workpiece 11 is subsequently rotated in a circular direction a predetermined number of degrees, whereby another groove is machined into the interior surface by the aforementioned procedure. All necessary grooves are machined into the workpiece 11 by repeating the above steps.

However, after the final groove has been machined into the workpiece 11, the grooves which are immediately adjacent to the final groove (i.e., located on each side of the final groove) are machined a second time by the forging die 8. This second machining of the grooves immediately adjacent to the final groove is necessary because these grooves swell out toward the center of the workpiece. If the second machining was not performed, the grooves immediately adjacent to the final groove would not be as precise as the other grooves, resulting in non-reliable control of hydraulic flow in the valve body. More specifically, if a valve body is determined to have eight grooves, the order of machining the grooves is as follows:

$1 \rightarrow 2 \rightarrow 3 \rightarrow 4 \rightarrow 5 \rightarrow 6 \rightarrow 7 \rightarrow 8 \rightarrow 7 \rightarrow 1$ This second machining of grooves 7 and 1 produces a valve body having uniform grooves. Upon completion of the necessary grooving, the interior surface of workpiece 11 is planed by an appropriate machining process to increase the precision of the interior bore of the workpiece 11. The machining of the workpiece will be accomplished by either hot or cold forging depending upon the material comprising the workpiece 11.

Figure 8:
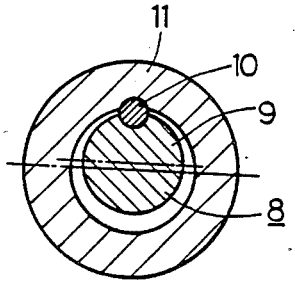
FIG. 8 is a transverse cross-sectional view of the machining device of FIG. 7 taken along the line VIII—VIII.
Figure 9:
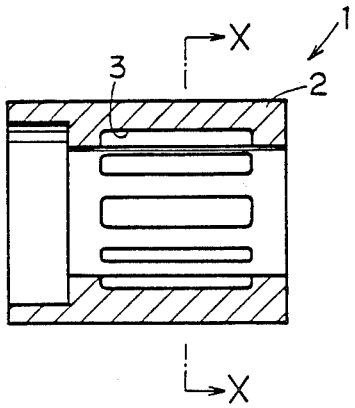
FIG. 9 is a longitudinal cross-sectional view of a valve body manufactured by the first embodiment of the claimed invention.
Figure 10:
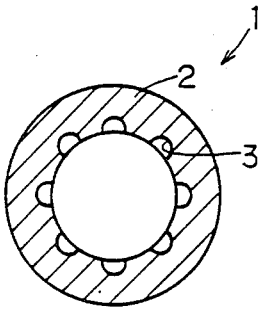
FIG. 10 is a transverse cross-sectional view of the valve body of FIG. 9 taken along the line X—X.

In FIGS. 9 and 10, the numeral 1 indicates a valve body manufactured by the embodiment of FIGS. 7 and 8. The slots 3 are rectangularly shaped in their longitudinal direction and the shape of the slots 3 allow a large amount of oil to flow therethrough. When the grooves 3 are formed by the superior aforementioned forging process, the previously difficult manner of machining grooves onto valve sleeve, to allow for the flow of hydraulic fluid, no longer presents a problem. In view of the endurance of the male die from the formed groove, and the occasional removal of the male die, it is preferable that transverse cross-sectional shape of groove be circular, as disclosed in FIG. 10. By utilizing this shape, the construction of the male die 10 is also facilitated.

Figure 11:
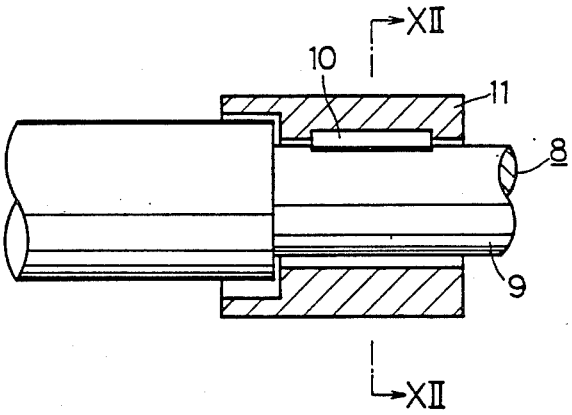
FIG. 11 is a longitudinal cross-sectional view illustrating the method of the second embodiment of the present invention.
Figure 12:
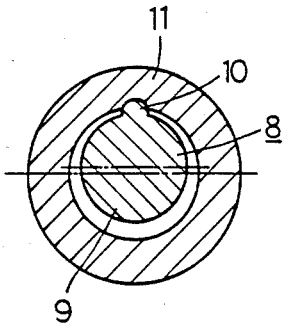
FIG. 12 is a transverse cross-sectional view of the machining device of FIG. 11 taken along the line XII—XII.

FIGS. 11 and 12, disclose the second embodiment of the claimed invention. The difference between the first embodiment, shown in FIGS. 7 through 10, and the second embodiment, shown in FIGS. 11 and 12, is that the male die 10 and the shaft portion 9 are separate elements in the first embodiment, but they are a single combined unit in the second embodiment. The other elements of the second embodiment are same as those of the first embodiment.

Figure 1:
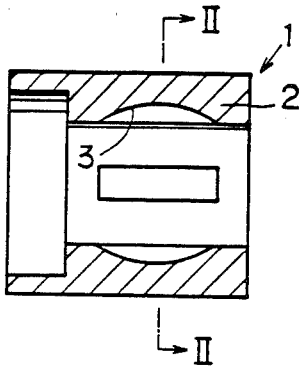
FIG. 1 is a longitudinal cross-sectional view of a valve body according to prior art.
Figure 2:
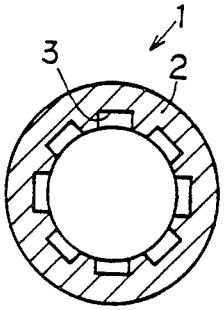
FIG. 2 is a transverse cross-sectional view of the valve body of FIG. 1 taken along the line II—II.
Figure 3:
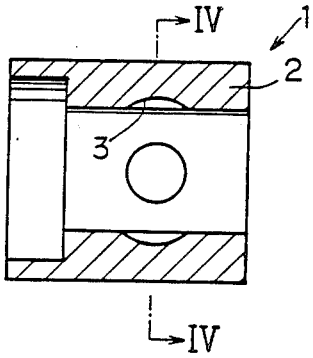
FIG. 3 is a longitudinal cross-sectional view of a valve body manufactured by a ball end mill machining, according to conventional teachings.
Figure 4:
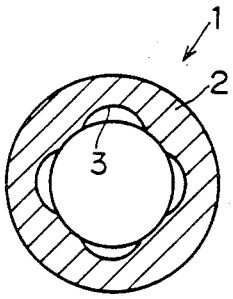
FIG. 4 is a transverse cross-sectional view of the valve body of FIG. 3 taken along the line IV—IV.
Figure 5:
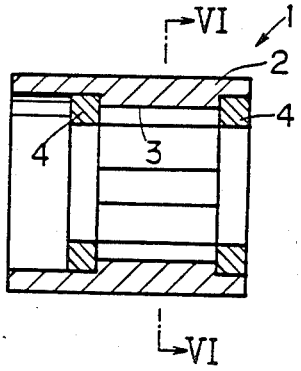
FIG. 5 is a longitudinal cross-sectional view of a three-piece valve sleeve, according to the prior art.
Figure 6:
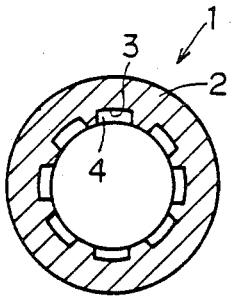
FIG. 6 is a transverse cross-sectional view of the valve body of FIG. 5 taken along the line VI—VI.
Figure 13:
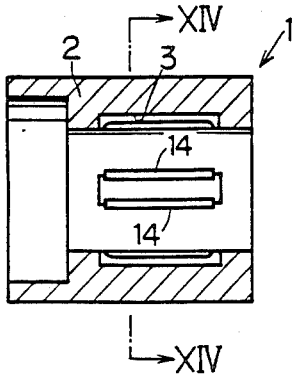
FIG. 13 is a longitudinal cross-sectional view of a valve body manufactured by another embodiment of the claimed invention.
Figure 14:
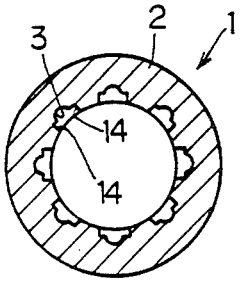
FIG. 14 is a transverse cross-sectional view of the valve body of FIG. 13 taken along the line XIV—XIV.
Figure 15:
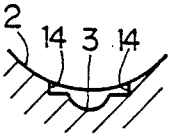
FIG. 15 is a partially enlarged view of FIG. 14.

FIGS. 13 through 15, show the valve body 1 of FIGS. 9 and 10 after subsequent machining of the peripheral portions 14 into the grooves 3 by the grooving machine. In this embodiment, both peripheral portions 14 of the grooves 3 are precisely formed. The peripheral portions 14 of the machined grooves are very important in the overall control of the precise flow of the hydraulic fluid. According to this third embodiment, the precision of the machining process is increased over the precision of the prior art devices disclosed in FIGS. 1 and 2. The result of using the claimed invention is a decrease in the manufacturing time and an increase in the machining precision. Moreover, in this embodiment, both axial ends of the peripheral portions 14 are designed to terminate within the axial ends of the previously machined grooves 3.

Figure 16:
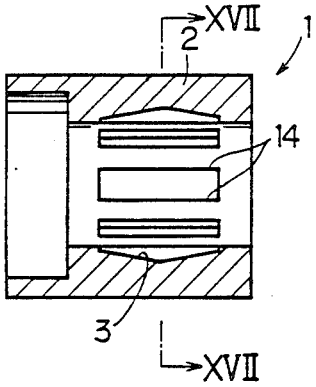
FIG. 16 is a longitudinal cross-sectional view of a valve body manufactured by another embodiment of the claimed invention.
Figure 17:
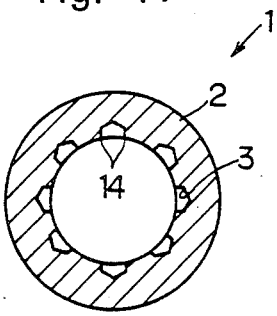
FIG. 17 is a transverse cross-sectional view of the valve body of FIG. 16 taken along the line XVII—XVII.

FIGS. 16 and 17, illustrate another shape of a groove manufactured by the aforementioned machining process. The longitudinal cross section shows the machined groove having four sides analogous to a sectioned hexagon, while the transverse cross section also shows a four sided "sectioned hexagon" groove. By utilizing the aforementioned "sectioned hexagon" grooves, the flow of hydraulic fluid can be precisely controlled without further machining of the peripheral portions 14, while maintaining a large hydraulic fluid flow.

Figure 18:
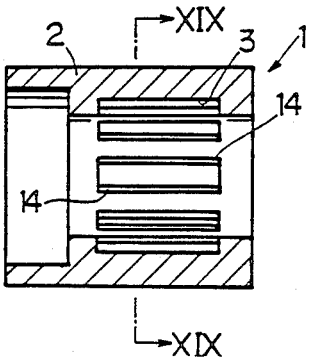
FIG. 18 is a longitudinal cross-sectional view of a valve body manufactured by another embodiment of the claimed invention.
Figure 19:
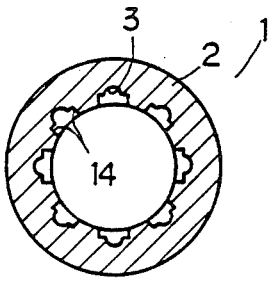
FIG. 19 is a transverse cross-sectional view of the valve body of FIG. 18 taken along the line XIX—XIX.
Figure 20:
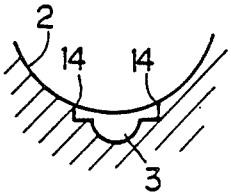
FIG. 20 is a partially enlarged view of FIG. 19.

In FIGS. 18 through 20, a valve body 1 with grooves 3 corresponding to the grooves 3 shown in FIGS. 13 through 15, is disclosed. However, these grooves are formed by using forging techniques exclusively. Therefore, it is unnecessary to consider machine tolerance. Hence, in this groove forming technique the peripheral portions 14 of grooves 3 extend to the axial ends of the grooves 3.

Figure 21:
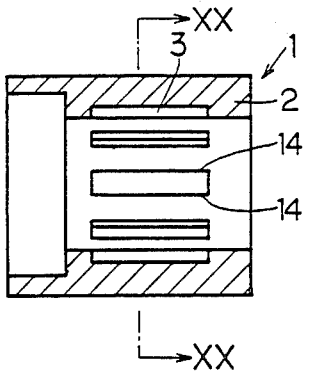
FIG. 21 is a longitudinal cross-sectional view of a valve body manufactured by another embodiment of the claimed invention.
Figure 22:
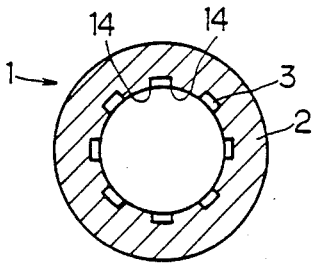
FIG. 22 is a transverse cross-sectional view of the valve body of FIG. 21 taken along the line XX—XX.

FIGS. 21 and 22 illustrate another shape of a groove according to the claimed invention. The longitudinal cross-sectional view displays a groove rectangular in shape and the transverse cross-sectional view shows the groove to be a combination of a circular arc with straight sides. By utilizing grooves of this shape, the resultant hydraulic fluid flow is precisely controlled, while simultaneously maintaining an increased flow rate over the prior art techniques disclosed herein.

While the present invention has been described in its preferred embodiments, it is to be understood that the invention is not limited thereto, and may be otherwise embodied within the scope of the following claims.

What is claimed is:

1. A method of machining a valve sleeve on a device having a base, a support member fixedly secured to the base, a shaft mounted on the support member, and a male die secured to the shaft, comprising:

(a) mounting an annular cylindrical workpiece on the male die;

(b) applying pressure to the workpiece in a direction toward the male die;

(c) forging the workpiece by applying pressure to it toward the male die, thereby forming a first groove on an interior surface of the workpiece;

(d) applying pressure to the workpiece in a direction away from the male die;

(e) rotating the workpiece a predetermined amount;

(f) repeating steps (c) through (e), thereby forming multiple grooves in the workpiece until a predetermined number of grooves have been formed in the workpiece ending with a final groove being formed adjacent to the first groove; and (g) machining at least one of the multiple grooves adjacent to the final groove a second time.

2. The method of claim 1, wherein the first groove is machined a second time and a groove which was machined immediately prior to machining the final groove is machined a second time.

3. A method of machining a valve sleeve on a device having a base, a support member fixedly secured to the base, a shaft mounted on the support member, and a male die secured to the shaft, comprising:

(a) mounting an annular cylindrical workpiece on the male die;

(b) applying pressure to the workpiece in a direction toward the male die;

(c) forging the workpiece by applying pressure to it toward the male die, thereby forming a first groove on an interior surface of the workpiece;

(d) applying pressure to the workpiece in a direction away from the male die;

(e) rotating the workpiece a predetermined amount;

(f) repeating steps (c) through (e), thereby forming multiple grooves in the workpiece until a predetermined number of grooves have been formed in the workpiece ending with a final groove being formed adjacent to the first groove; and (g) machining the first groove a second time and a groove which was machined immediately prior to machining the final groove a second time.

* * * * *